US007753747B1

(12) United States Patent
Jones et al.

(10) Patent No.: US 7,753,747 B1
(45) Date of Patent: Jul. 13, 2010

(54) ELECTRIC POWERED BOAT

(75) Inventors: Frank W. Jones, Willow Spring, NC (US); Warren D. Lee, Dunn, NC (US)

(73) Assignee: Twin Troller Boats, Inc., Benson, NC (US)

( * ) Notice: Subject to any disclaimer, the term of this patent is extended or adjusted under 35 U.S.C. 154(b) by 0 days.

(21) Appl. No.: 11/972,251

(22) Filed: Jan. 10, 2008

(51) Int. Cl.
*B63H 5/16* (2006.01)
*B60L 11/00* (2006.01)
*B63H 21/17* (2006.01)

(52) U.S. Cl. ..... 440/69; 440/6

(58) Field of Classification Search ..... 440/6, 440/66–70; 114/255, 288, 290, 292, 55.5, 114/55.54, 56.1, 61.1, 61.24
See application file for complete search history.

(56) References Cited

U.S. PATENT DOCUMENTS 2,983,246 A * 5/1961 Manley ..... 440/72
3,848,561 A * 11/1974 Price ..... 440/69
RE33,165 E * 2/1990 Whitehead ..... 440/69
4,941,423 A * 7/1990 Van Tassel ..... 114/289
5,131,875 A 7/1992 Lee
5,376,028 A * 12/1994 Koyanagi ..... 440/41
7,267,590 B1 * 9/2007 Jones et al. ..... 440/69

* cited by examiner

*Primary Examiner*—Daniel V Venne
(74) *Attorney, Agent, or Firm*—Coats & Bennett, P.L.L.C.

(57) ABSTRACT

A boat hull includes a pair of spaced apart cavities formed in the bottom thereof. Mounted within each cavity is an electric trolling motor. An air purge system is provided for purging air from each cavity when the boat rests on a water surface. Additionally each cavity is closed at front and rear ends and is open from the bottom. The depth of each cavity varies from front to rear with a maximum depth occurring generally intermediately between the ends. In operation each trolling motor generates a propulsion stream of water that is directed generally rearedly and downwardly from the rear end of each cavity.

19 Claims, 6 Drawing Sheets

ELECTRIC POWERED BOAT

SUMMARY OF THE INVENTION

A trolling boat includes a hull having two spaced apart cavities formed in the bottom thereof. An electric trolling motor is mounted in each cavity. The depth of the cavities varies. In one embodiment the cavity is relatively deep in an intermediate area and relatively shallow along opposite end portions of the cavity. Further in one embodiment because of the configuration of the cavity, the electric trolling motor in each cavity generates a propulsion stream of water that is directed generally rearwardly and downwardly from the end of the cavity. In addition, in one embodiment there is provided an air purge line for removing air from each of the cavities. At least one valve is provided for opening and closing the air purge line such that when the valve assumes an open position, at least some of the air within the cavity can be removed from the cavity through the purge line.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, a trolling boat is depicted generally by the numeral 10. Trolling boat 10 is a relatively small and highly maneuverable watercraft that is particularly useful as a recreational boat on ponds and lakes.

Trolling boat 10 includes a hull indicated generally by the numeral 12. Hull 12 includes a top, bottom, sides and front and rear areas. Hull 12 can be manufactured from various materials utilizing various processes. However it is contemplated that in one embodiment the hull would be constructed of high density polyethylene through a rotational molding or vacuum molding process.

Figure 1:
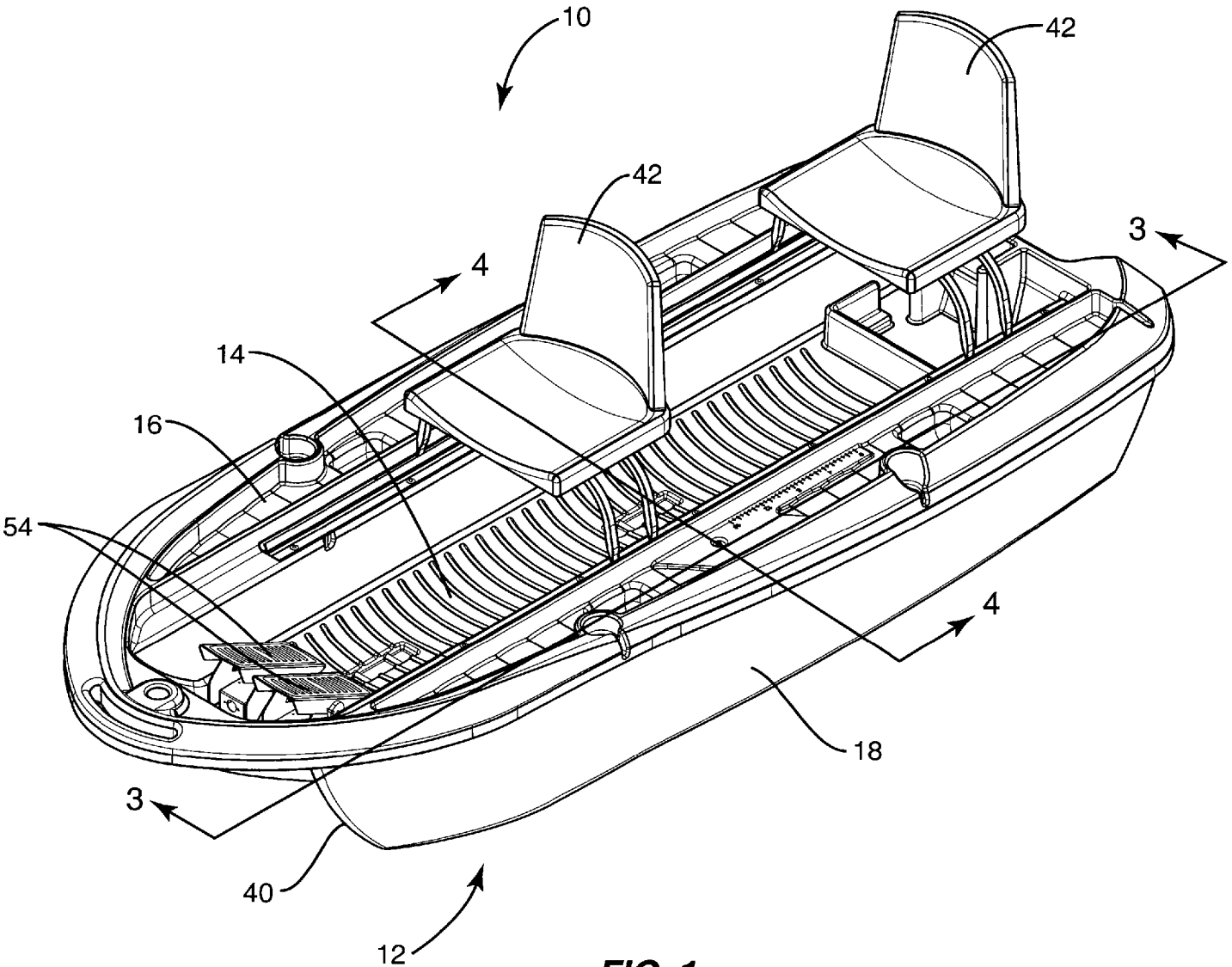
FIG. 1 is a perspective view of the trolling boat.

As seen in FIG. 1, hull 12 includes a top deck. Forming a part of the top deck is a central sunken section or portion 14. This section of the top deck extends substantially the length of the hull. Disposed adjacent the central sunken portion 14, on each side thereof, is a raised deck 16.

Hull 12 further includes a pair of opposed sides or side walls 18 and a bottom indicated generally by the numeral 20. Bottom 20 includes a central portion 20A (FIG. 2).

Formed in the bottom 20 is a pair of spaced apart cavities, each indicated generally by the numeral 22. Each cavity 22 is defined by a wall structure. Further each cavity includes an elongated opening formed in the bottom thereof. As seen in FIGS. 2 and 3, each cavity 22 is elongated and extends substantially throughout the length of the hull 12. As will be described later, each cavity is closed about the opposite ends and assumes a shape that is shown in FIGS. 3, 6A, 6B, and 6C.

Figure 5:
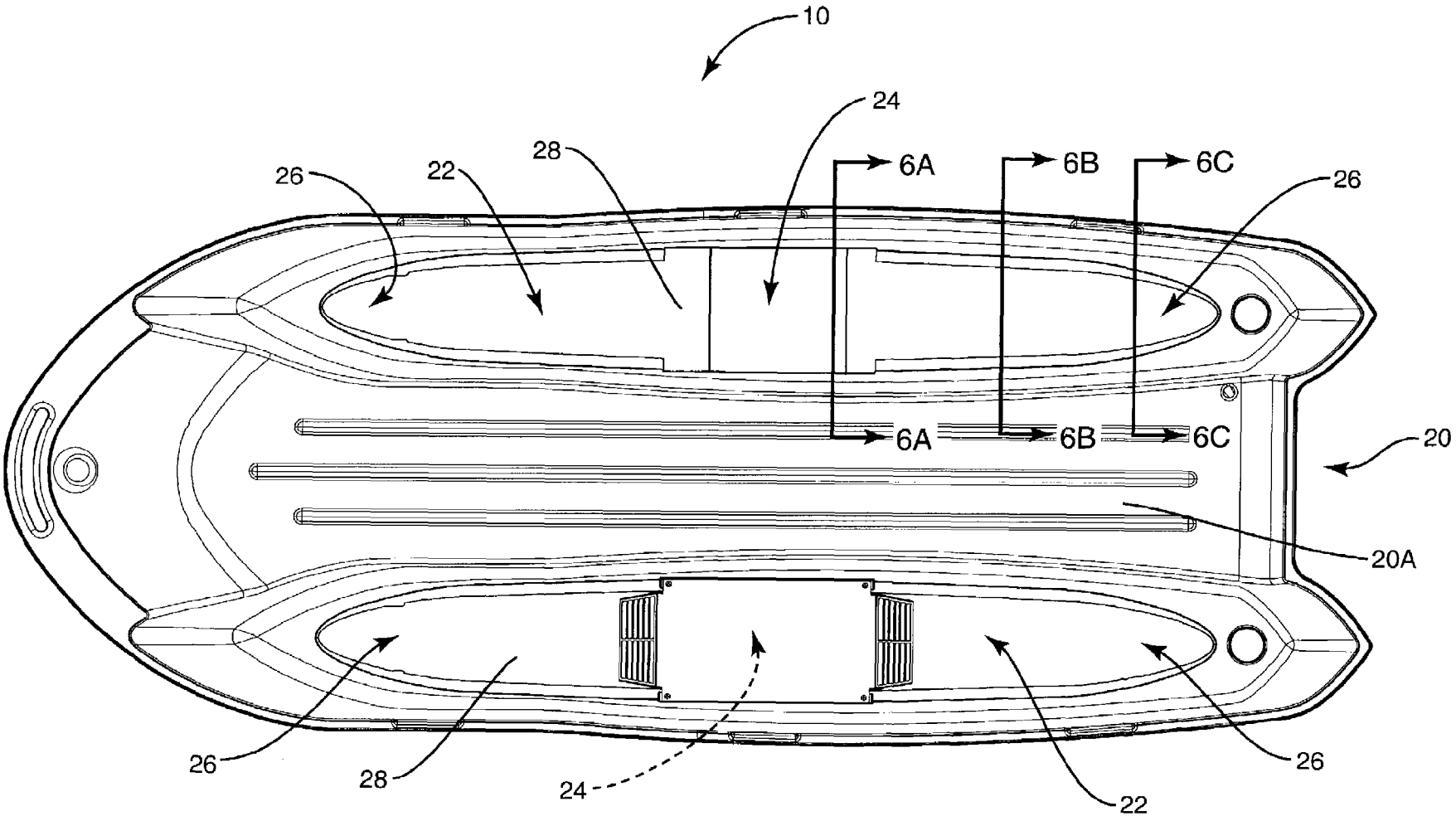
FIG. 5 is a plan view of the bottom of the trolling boat.
Figure 6A:
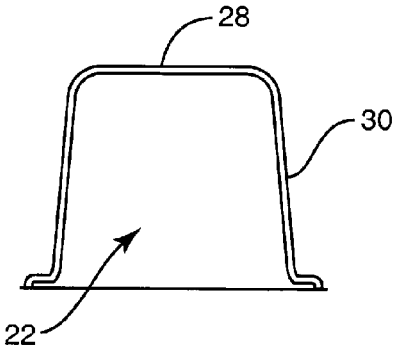
FIG. 6A is a cross-sectional view taken through the line 6A-6A of FIG. 5.
Figure 6B:
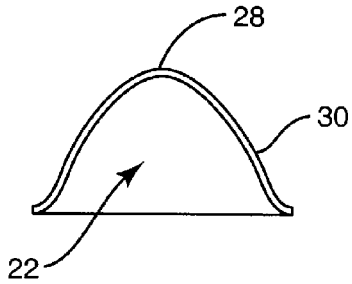
FIG. 6B is a cross-sectional view taken through the line 6B-6B of FIG. 5.
Figure 6C:
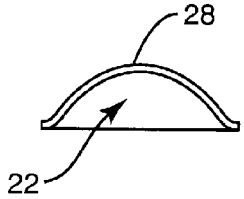
FIG. 6C is a sectional view taken through the line 6C-6C of FIG. 5.

For purposes of reference, each cavity 22 includes an intermediate portion or area indicated generally by the numeral 24 and opposed end portions or areas indicated generally by the numeral 26. See FIGS. 5 and 7A. Note that the intermediate portion 24 of the cavity 22 is relatively deep. As the cavity 22 extends towards opposite ends, the depth of the cavity becomes more shallow. As noted above, each cavity is defined by an internal wall structure. This wall structure includes a top portion 28 and side portions 30. Note that the shape of the wall structure including the top 28 and the side portions 30 changes along the length of each cavity. FIG. 6A is a sectional view taken through one of the cavities 22 shown in FIG. 5 about an intermediate portion 24 of the cavity. For purposes of illustration, the trolling motor guard has been removed from this cavity. In any event note that the cavity in this area assumes the shape shown in FIG. 6A. That is the top 28 is generally flat or horizontal and the side portions 30 are generally straight. As one moves from the intermediate area 24 towards either end, the shape of the cavity 22 changes. FIG. 6B is a sectional view taken between the intermediate portion 24 of the cavity and an extreme end of the cavity. In this area, the wall structure assumes a more curved or arcuate shape. Note that the top 28 is more curved or concaved shaped. Note further that the side portions 30 become shorter and are disposed at more of an angle than the side portions 30 shown in FIG. 6A. Further down the cavity 22 towards the extreme end, the cavity assumes the shape shown in FIG. 6C. Note that the cavity 22 becomes substantially more shallow than that shown in FIG. 6A and that the top 22 assumes a curved or arcuate configuration.

Figure 2:
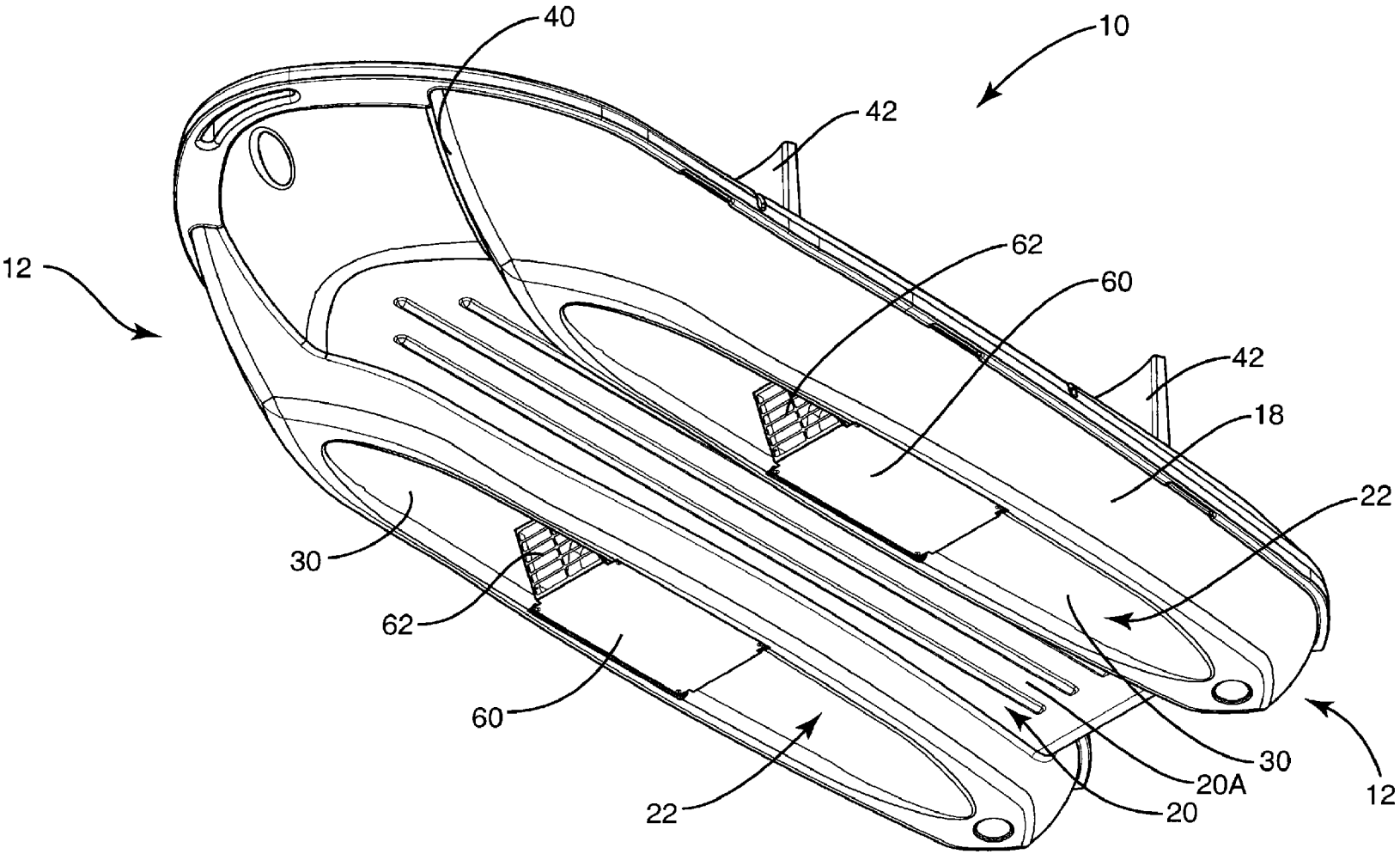
FIG. 2 is a perspective view of the trolling boat showing the bottom thereof.
Figure 3:
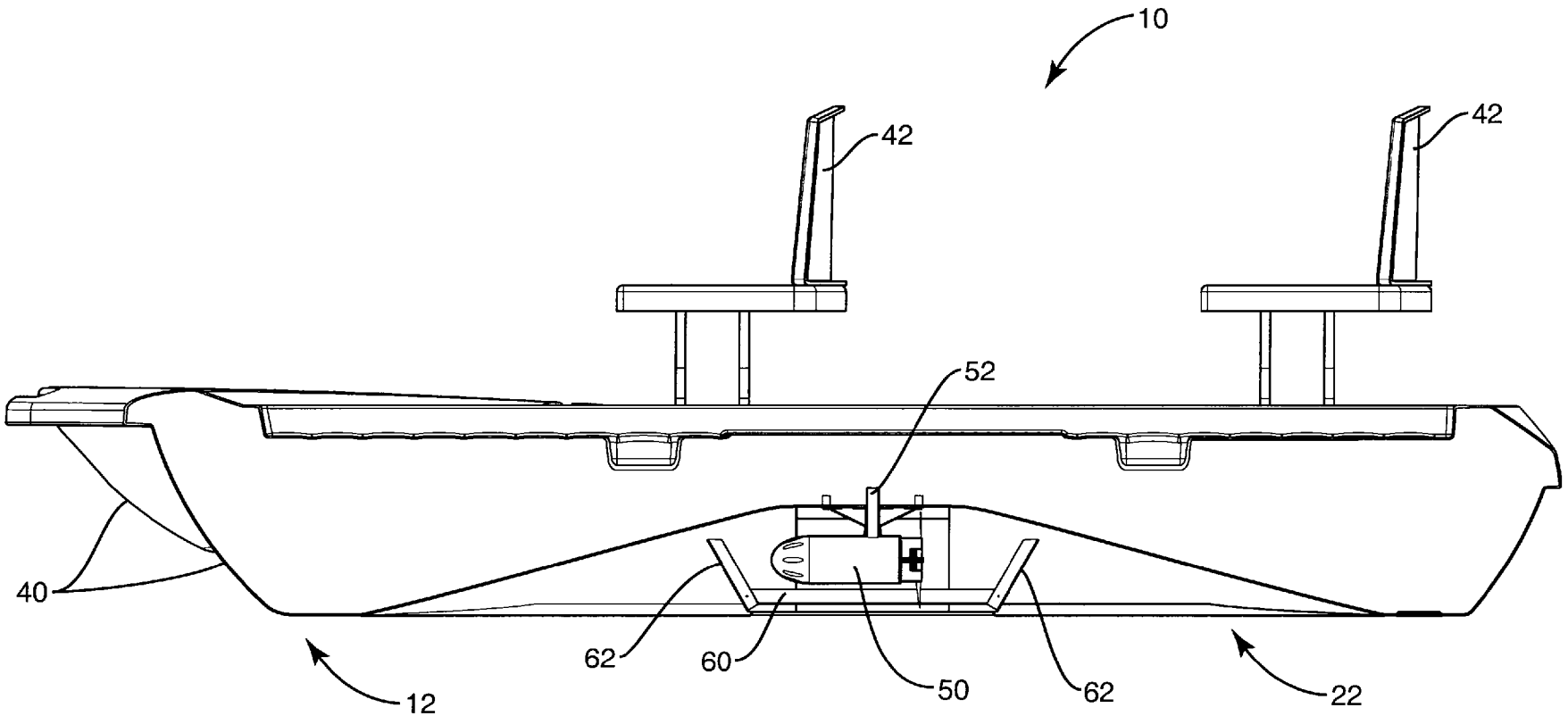
FIG. 3 is a sectional view taken through the line 3-3 of FIG. 1.

As seen in FIGS. 1-3, the front or bow portion of boat 10 includes a pair of keels 40. The keels 40 form a point and function to cut through the water as the trolling boat 10 is propelled, generally preventing splashing. Each keel 40 is generally aligned with a respective cavity 22.

Mounted on the top deck of the boat 10 is one or more seats 42. Each seat 42 includes a seat frame that transversely spans the central sunken section 14 of the hull 12. In the case of one embodiment, the seat frame includes arms that extend from each side of the seat and attach to a runner that is retained within a longitudinal groove or slot formed in a portion of the raised deck 16. In this embodiment, the seats 42 can be adjusted fore and aft along the deck structure of the boat.

Mounted in each cavity 22 is an electric trolling motor 50. This is particularly illustrated in FIG. 3. Details of the electric trolling motors 50 are not dealt with herein because such is not per se material to the present invention and furthermore electric trolling motors are well known in the art. Each trolling motor 50 is supported within a respective cavity 22 by a support shaft 52 that extends downwardly through the hull and into a respective cavity. Support shaft 52 suspends the trolling motor 50 at an appropriate depth within each respective cavity 22. Note in FIG. 3 where the trolling motor 50 lies above the bottom of the cavity 22 and below the top 28 of the cavity in the intermediate area 24. Support shaft 52 supports the trolling motor 50 in a fixed location within the cavity 22. The electric motor and propeller that form each trolling motor 50 is longitudinally aligned with the cavity 22. Note that in the area occupied by the trolling motor 50, that the wall structure of the cavity 22 extends around the trolling motor 50. The trolling motors 50 are powered by one or more batters not shown. There are provisions within the hull 12 for holding the one or more batteries and for directing wiring from controls through the hull to each of the trolling motors 50. It is appreciated that when the trolling motors 50 are operating in the "forward" direction, water will enter the front of the cavities and move past the trolling motors and out the back of the cavities. When the motors are operating in "reverse", water will enter the rear ends of the cavities, move past the trolling motors and exit the front end the cavities.

In order to control both the propulsion and steering of the boat 10, there is provided a pair of foot pedals 54. Foot pedals 54 are disposed in the front portion of the central sunken area 14 of the deck and can be adjustable both laterally and longitudinally. Each pedal controls one of the electric trolling motors 50. There is both a "forward" and "reverse" control and the foot pedals 54 provide variable speed control in both forward and reverse directions. Details of the controls are not dealt with herein because such is not per se material to the present invention and such controls are known in the art. For a more detailed and unified understanding of a trolling boat, one is referred to the disclosures found in U.S. Pat. Nos. 5,131,875 and 7,267,590, the disclosures of which are expressly incorporated herein by reference.

To protect the trolling motors 50, each cavity is provided with a trolling motor guard. This is shown in FIGS. 2 and 3. Each trolling motor guard includes a bottom 60 that is secured underneath the trolling motor 50. Extending upwardly from opposite ends of the bottom 60 is a pair of ends 62. Ends 62 are generally perforated and in the form of a screen or an open frame work to permit water to pass there through.

Figure 7A:
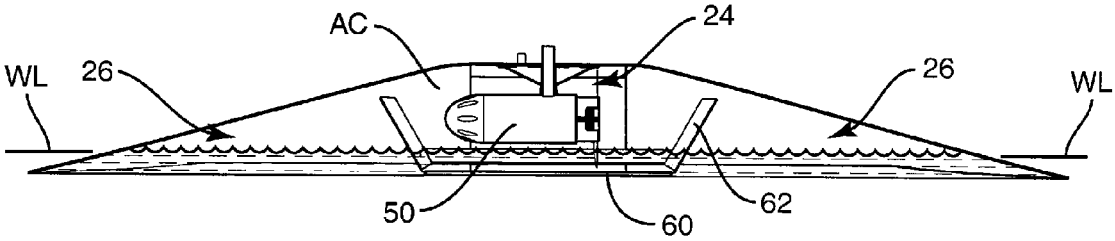
FIG. 7A is a schematic illustration showing the water line extending through a lower portion of the cavity of the boat in a no load condition.

FIG. 7A is a schematic that illustrates the general conditions that exist when the boat 10 assumes a position in the water in a no load condition. By no load it is meant that the boat 10 does not support people. In this condition the boat 10 includes a water line WL. Note in FIG. 7A where the water line WL in this no load condition extends above the bottom of the cavity 22 but below the top 28 of the cavity in the intermediate area 24. In this condition, air is usually trapped in the cavity. As noted in FIG. 7A, the cavity along with the water surface forms an air chamber AC in the cavity.

Figure 4:
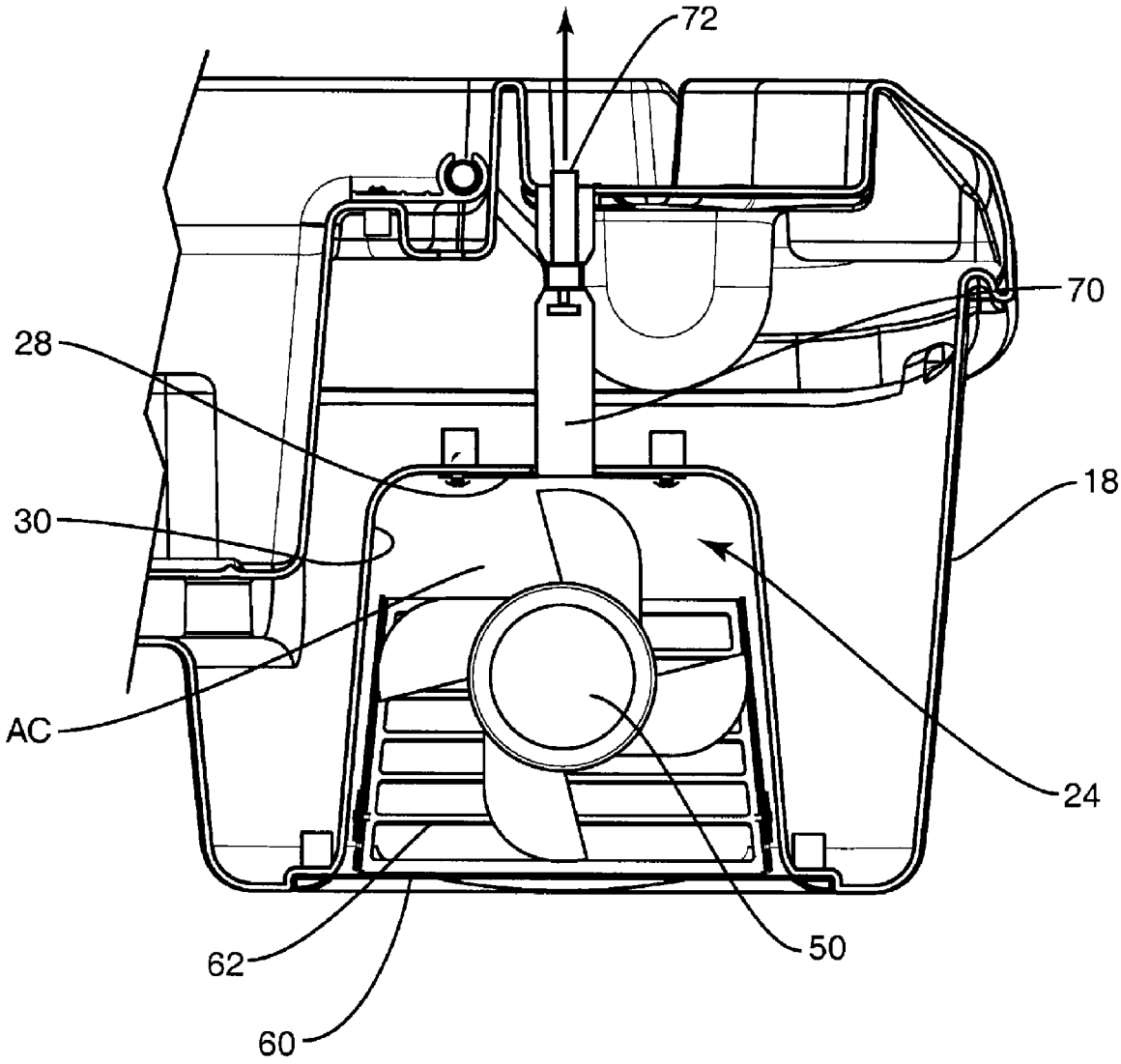
FIG. 4 is a partial sectional view taken through the line 4-4 of FIG. 1.

Boat 10 is provided with an air purging system for purging air from the formed air chamber AC. See FIG. 4. The air purging system includes one or more purge lines 70. These purge lines 70 extend through the hull and into each cavity 22. The purge lines can form a network that extend into both cavities 22, or there may simply be one purge line associated with each cavity as is the case with the embodiment illustrated. In any event there is provided a control valve 72 for opening and closing the purge line 70. The valve is normally closed and is opened to purge air from the cavity in certain situations. In the embodiment illustrated in FIG. 4, the valve 72 is a spring loaded valve that is accessible from the deck and which can be pushed down, as shown in FIG. 4, to an open position. That is, in FIG. 4, the valve 72 is shown in a pushed down or lowered position which opens the valve and permits air to move from the air chamber AC through the purge line 70, and out the valve 72. When the valve 72 is released, it is spring biased upwardly to a closed position. The valve 72 shown in FIG. 4 is a schematic illustration of one type of manually actuated valve that could be used in conjunction with the air purge system. It will be understood and appreciated by those skilled in the art that various other types and forms of valves can be incorporated to enable the operator of the boat to purge air from the cavities 22.

Figure 7B:
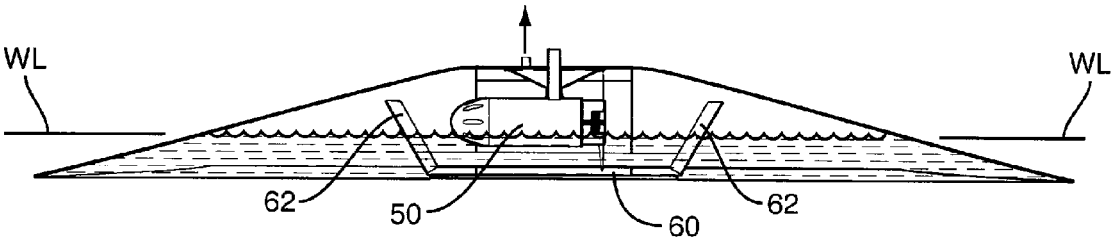
FIG. 7B is a schematic illustration similar to FIG. 7A but wherein air has been purged from an air chamber formed in the cavity of the trolling boat.

In the no load condition shown in FIG. 7A, ordinarily air is captured and held within the air chamber AC. When one or more persons occupies the boat 10, the manually actuated valve or valves associated with the purge line is opened causing air to escape from the cavities. This is illustrated in FIG. 7B. Once the boat 10 is occupied by one or more persons and the air has been purged from the cavities 22, then the water line WL moves up slightly. In FIG. 7B note that when the air has been purged from the cavity 22 and the boat occupied by one or more persons, that the water line WL extends intermediately between the bottom of the cavity and the top of 28 in the intermediate area 24 of the cavity.

Figure 7C:
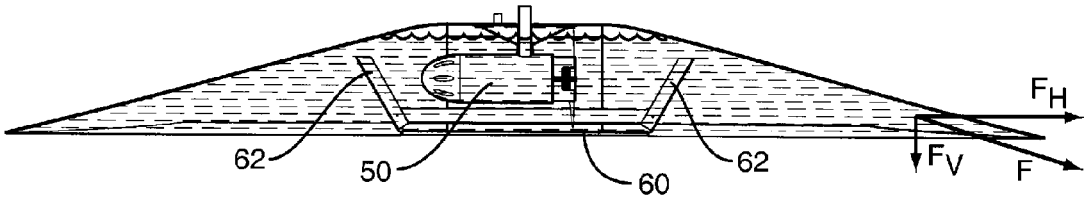
FIG. 7C is a schematic illustration similar to FIGS. 7A and 7B but illustrating the conditions within the cavity during normal operation of the trolling boat.

FIG. 7C illustrates conditions in each cavity when the boat 10 is being propelled through the water. The actuation of the trolling motors 50 causes water to be drawn and pumped into the cavity 22 substantially filling the same as shown in FIG. 7C. During operation, when the trolling motors 50 are in a "forward" position, the trolling motors 50 generate a propulsion stream of water that passes from the forward end of the cavity 22, through the cavity and out the rear end. This propulsion stream is at least partially guided by the configuration of the cavity itself. Since the rear end portion of the cavity 22 is angled downwardly, it followed that the propulsion stream will be exhausted or discharged out the rear of the cavity at an angle. That is the propulsion stream of water discharged will be directed generally rearwardly and downwardly from the rear end of the cavity. This is illustrated by vectors in FIG. 7C. The propulsion stream of water is generally discharged in the direction of vector F and will have a horizontal component $F_H$ and a vertical component $F_V$. In the end the propulsion stream will drive or propel the boat 10 forwardly through the water. The same dynamics apply when the boat is moved in a "reverse" direction. In this case, the propulsion stream or water is discharged in a like manner from the front end of the cavity 22.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A trolling boat, comprising:

a molded hull having opposed sides, front, rear and bottom;

a pair of spaced apart cavities formed in the bottom of the hull with each cavity being spaced inwardly from an adjacent side of the hull and at least partially open from the bottom;

an electric trolling motor mounted in each cavity intermediately between the front and rear of the hull;

an air purge line for removing air from each of the cavities;

at least one valve for opening and closing the air purge line such that when the valve assumes an open position at least some of the air within the cavity can be removed from the cavity through the air purge line;

wherein each cavity includes a wall and wherein the air purge line extends from the wall;

wherein each cavity includes the wall that forms the top and sides of the cavity and wherein the wall encloses opposite ends of the cavity; and wherein there is formed an elongated opening in the bottom of the cavity that permits water to enter the cavity;

wherein the depth of each cavity varies from the front of the cavity to the back of the cavity with the depth of the cavity in an intermediate area of the cavity being greater than the depth of the cavity at opposite end portions of the cavity; and wherein the wall of each cavity includes a shape and wherein the shape of the wall about opposite end portions is symmetrical.

2. The trolling boat of claim 1 wherein the wall includes an upper portion that assumes a generally curved configuration about opposite end portions of the cavity.

3. The trolling boat of claim 2 wherein the upper portion of the wall about the intermediate portion of the cavity assume a generally flat configuration, and wherein the flat configuration of the upper portion of the wall is transformed into a curved configuration as the upper portion of the wall extends toward opposite ends of the cavity.

4. The trolling boat of claim 1 including a water line that extends above the bottom of each cavity and substantially below the top of the cavity in an intermediate area of the cavity such that when the boat assumes a position in the water an air chamber is defined in each cavity above the surface of the water.

5. The trolling boat of claim 4 wherein the air purge line is communicatively connected to the air chamber formed in each of the cavities.

6. A trolling boat comprising:

a molded hull having opposed sides, front, rear and bottom;

a pair of spaced apart elongated cavities formed in the bottom of the hull with each cavity being spaced inwardly from an adjacent side of the hull;

each cavity being elongated and having an elongated open bottom and a wall that forms the top, sides and closed opposed ends of the cavity;

the depth of the cavity from front to back varying with an intermediate portion of the cavity having a greater depth than opposite end portions of the cavity;

wherein the wall of each cavity includes a shape and wherein the shape of the wall about opposite end portions of the cavity is symmetrical; and an electric trolling motor mounted in an intermediate portion of each of the cavities.

7. The trolling boat of claim 6 wherein the top of the wall extends generally downwardly from the intermediate portion towards opposite ends of the cavity; and wherein the top of the wall along opposite end portions of the cavity assumes a generally curved configuration.

8. The trolling boat of claim 7 wherein the depth of each cavity progressively becomes smaller from an intermediate portion of the cavity toward opposite ends of the cavity.

9. The trolling boat of claim 6 including a trolling motor guard disposed in each cavity for guarding the trolling motor disposed within the cavity.

10. The trolling boat of claim 9 wherein each guard includes a bottom extending underneath the trolling motor and fore and aft perforated ends that extend adjacent the trolling motor.

11. The trolling boat of claim 8 wherein the shape of each cavity results in a propulsion stream that is directed generally rearwardly and downwardly from the end portion of each cavity.

12. A trolling boat, comprising:

a molded hull having opposed sides, front, rear and bottom;

a pair of spaced apart cavities formed in the bottom of the hull with each cavity being spaced inwardly from an adjacent side of the hull and at least partially open from the bottom;

each cavity being elongated and having a wall that forms the top, sides and closed ends of the cavity;

an electric trolling motor mounted in each cavity intermediately between the front and rear of the hull with each electric trolling motor operative to generate a propulsion stream of water;

each cavity including a rear end and means for directing the propulsion stream of water generally rearwardly and downwardly from the rear end of the cavity; and wherein the wall of each cavity includes a shape and wherein the shape of the wall about opposite end portions of the cavity is symmetrical.

13. The trolling boat of claim 12 further including an air purge line for removing air from each of the cavities; and at least one valve for opening and closing the air purge line such that when the valve assumes an open position at least some of the air within the cavity can be removed from the cavity through the air purge line.

14. The trolling boat of claim 12 wherein the depth of each cavity varies from the front of the cavity to the back of the cavity with the depth of the cavity in an intermediate area of the cavity being substantially greater than the depth of the cavity at opposite end portions of the cavity.

15. The trolling boat of claim 12 wherein the wall structure forms opposite sides and top of the cavity and wherein the top of the wall structure about opposite end portions is generally curved, and wherein the top of each cavity tapers downwardly from an intermediate portion of the cavity to opposed ends.

16. The trolling boat of claim 6, wherein each cavity includes a front half section and rear half section and wherein the shape of the front and rear half sections of each cavity are substantially identical.

17. The trolling boat of claim 16, wherein the boat includes a length and wherein each cavity extends substantially the entire length of the boat.

18. The trolling boat of claim 1, wherein each cavity includes a front half section and a rear half section wherein the shape of the front and rear half sections of each cavity are substantially identical, and wherein the boat includes a length and wherein each cavity extends substantially the entire length of the boat.

19. The trolling boat of claim 6 wherein each cavity formed in the bottom of the hull assumes an inverted trough shape as each cavity only opens at the bottom of the cavity while the top, sides and ends of the cavity are closed.

* * * * *